United States Patent [19]

Edwards et al.

[11] Patent Number: 4,744,296

[45] Date of Patent: May 17, 1988

[54] IMPRINTER APPARATUS WITH DOCUMENT ACTIVATED DOCUMENT AND CARD CARRIER

[75] Inventors: David G. Edwards, Dublin; Gerard Finlay, Navan; David J. Boyle, Leixlip, all of Ireland

[73] Assignee: Security Imprinter Corporation, Walkersville, Md.

[21] Appl. No.: 99,407

[22] Filed: Sep. 17, 1987

Related U.S. Application Data

[63] Continuation-in-part of Ser. No. 834,634, Feb. 28, 1986, abandoned.

[30] Foreign Application Priority Data

Jun. 4, 1985 [IE] Ireland ..... 1375/85

[51] Int. Cl.[4] ..... B41F 3/04; B41J 11/54; B41J 29/42

[52] U.S. Cl. ..... 101/269; 101/DIG. 18; 400/48; 400/596; 400/707.1

[58] Field of Search ..... 101/269, DIG. 18; 400/23, 48, 703, 596, 707.1; 250/461.1

[56] References Cited

U.S. PATENT DOCUMENTS

| | | | |
|---|---|---|---|
| 4,019,619 | 4/1977 | Emenaker | 400/703 X |
| 4,085,675 | 4/1978 | Yoshikawa et al. | 101/269 |
| 4,229,113 | 10/1980 | Andersen et al. | 400/596 |
| 4,401,029 | 9/1983 | Barbour | 101/269 |

FOREIGN PATENT DOCUMENTS

| | | | |
|---|---|---|---|
| 103887 | 6/1982 | Japan | 101/DIG. 18 |
| 126690 | 8/1982 | Japan | 101/DIG. 18 |
| 138975 | 8/1982 | Japan | 101/DIG. 18 |
| 20479 | 2/1983 | Japan | 420/596 |
| 2133744 | 8/1984 | United Kingdom | 101/DIG. 18 |

*Primary Examiner*—Edgar S. Burr
*Assistant Examiner*—James R. McDaniel
*Attorney, Agent, or Firm*—Mason, Fenwick & Lawrence

[57] ABSTRACT

A document activated imprinter apparatus for imprinting characters from a credit card comprising a housing with entrance and exit slots, imprinting means, a carrier member with a flat upwardly facing surface, receiving and positioning means, guiding and reciprocating means and forward drive means.

18 Claims, 4 Drawing Sheets

IMPRINTER APPARATUS WITH DOCUMENT ACTIVATED DOCUMENT AND CARD CARRIER

PRIOR RELATED APPLICATIONS

This application is a continuation-in-part of our earlier application Ser. No. 834,634, filed Feb. 28, 1986 now abandoned.

BACKGROUND AND OBJECTS OF THE INVENTION

The present invention relates to imprinter apparatus for imprinting characters from a character imprint source member such as a credit card onto an imprint recording document such as a document.

According to the invention, there is provided imprinter apparatus for imprinting characters from a character imprint source member such as a credit card onto an imprint recording document such as a document, the apparatus comprising a housing having entrance and exit openings for introduction and discharge of a document, imprinting means in the housing, a carrier member movable within the housing along a teed path between a document receiving start position and a document discharge position, and drive means to drive the carrier member along the feed path to imprint characters from an imprint source member onto a document.

In one embodiment of the invention, the drive means comprises a drive roller, the carrier member being passed between the drive roller and the imprinting means to imprint characters from a source member onto a document. Preferably the drive roller has a substantially cylindrical periphery interrupted by a flattened portion, the cylindrical portion of the drive roller engaging the carrier member to advance the carrier member between the start and discharge positions and the flattened portion allowing relative sliding movement of the carrier member for return of the carrier member to the start position.

In another embodiment ot the invention, return means are provided for returning the carrier member to the start position. Preferably the return means comprises a tension spring.

The drive roller is preferably driven by an electric motor, which may be coupled to the drive roller by a drive belt.

In a further embodiment of the invention, document sensor means are provided to sense the presence of a document on the carrier member to drive the driver roller. Preferably the sensor means comprises a microswitch which is positioned to be activated by a document to energize the motor for driving the carrier member through an imprinting stroke.

Means are provided for retaining the microswitch activated during an imprinting stroke. This means may comprise a cam on the drive roller shaft, the cam profile being arranged so that when the carrier member completes an imprinting stroke the microswitch is deactivated.

The carrier member comprises a platen having a substantially flat upwardly facing surface for receiving a character imprint source member and having means for receiving an positioning an imprint recording document. Preferably the means for receiving and positioning an imprint recording document comprises an abutment extending upwardly from a document supporting surface to be abutted by a leading edge of a document upon insertion through the entrance opening. Advantageously, the sensor means is positioned to be activated by portion of a document upon reaching the abutment surface.

In a further embodiment of the invention guide means are provided for guiding the carrier member along the feed path to pass the character source member and document between the drive roller and the imprint means. Preferably the guide means comprise a guide slot engaged by an elongate protrusion extending from the carrier member. In a still further embodiment of the invention, means to deliver an imprinted document from the apparatus through the exit opening is provided. Preferably the delivery means comprises a guide finger member extending into a groove in the carrier member when the carrier member approaches a discharge end position to move underneath the document and direct it through the exit opening.

In a particularly preferred embodiment of the invention there is provided document activated imprinter apparatus for imprinting characters from a credit card or the like forming a thin character bearing imprint member onto a document, comprising a housing having entrance and exit openings for introduction and discharge of a document onto which characters are to be imprinted, imprinting means in the housing including a printing station having an imprint roller and a drive roller between which the document and imprint member are to be advanced, a carrier member movable within the housing along a feed path between a document receiving start position and a document discharge end position for advancing a document fed onto the carrier member through said entrance opening between said rollers, means on said carrier member for receiving and positioning the imprint member adjacent the document disposed on the carrier member to imprint characters on the document upon their passage between said rollers, means for guiding and reciprocating said carrier member and the document and imprint member thereon along said feed path, powered drive means including a document sensor to sense the presence of a document at a support position on the carrier member to drive said drive roller through a carrier member imprint stroke along said feed path, means for guiding the document through said exit opening upon the carrier member reaching said end position, and means for returning the carrier member to said start position.

The invention will be more clearly understood from the following description of an embodiment thereof, given by way of example only, with reference to the accompanying drawings.

DETAIL DESCRIPTION OF A PREFERRED EMBODIMENT

Figure 3:
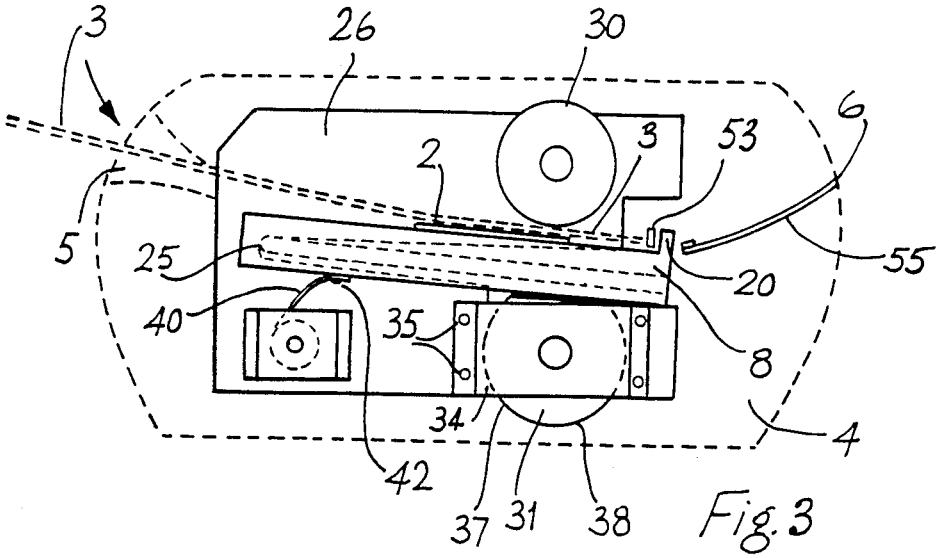
FIG. 3 is a side view of the apparatus of FIG. 1 in an initial or reset position.
Figure 4:
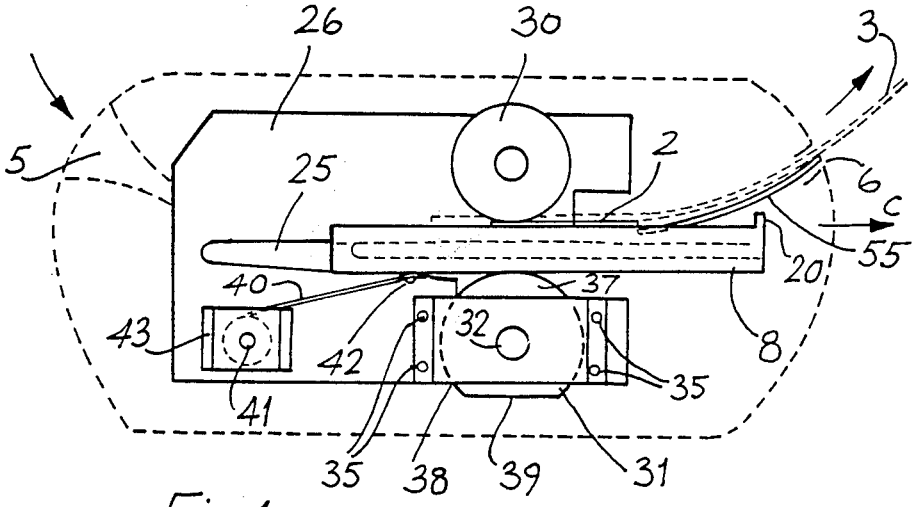
FIG. 4 is a side view of the apparatus of FIG. 1 with the carrier member disposed along its path of travel in an imprinting cycle.
Figure 7:
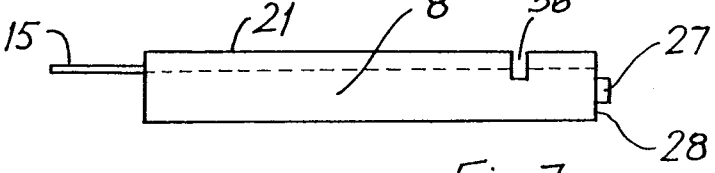
FIG. 7 is an end view of the carrier member of FIG. 5 in the direction of the arrow A.

Referring to the drawings, there is illustrated imprinter apparatus according to the invention, indicated generally by the references numeral 1 for imprinting characters from a character imprint source member such as a credit card 2 onto an imprint recording document such as a document 3. The credit card 2 is illustrated in FIGS. 3 and 4 in full lines and in broken lines in FIG. 6 while the document 3 is illustrated in broken lines in FIGS. 3 to 6.

The apparatus 1 comprises a housing 4 having an upper entrance opening 5 and an upper discharge opening 6 for introduction and discharge of the document 3. The credit card 2 is mounted on a carrier member comprising a platen 8 portion 9 of which projects, in use, through an elongate slot 10 in a side wall 11 of the housing 4.

The carrier member 8 includes a credit card receiving sheet metal member 15 having a pair of side members 16 which are bent upwardly inwardly to engage the side edges of the credit card 2. Character identifying details of the merchant using the apparatus are provided at 18 on the platen 8. A date roller 19 is also provided. Means for receiving and positioning the document 3 comprises an abutment 20 extending upwardly from a document supporting surface 21 to be abutted by a leading edge of the document 3 upon insertion of the document 3 through the entrance opening 5. The carrier member 8 runs in a guide comprising a substantially V-shaped slot 25 formed in a metal support 26. The slot 25 engages an elongate protrusion 27 extending from one side 28 of the carrier member 4.

The carrier member 8 is driven beneath an imprint means which in this case is provided by an inked roller 30 for imprinting the characters onto the document 3. The inked roller 30 is provided in a cassette 29 which, if desired may be disposable once the ink has been used up. Where the roller 30 or cassette 29 is disposable, it is envisaged that the cassette 29 may be attached to the apparatus by a suitable quick release mechanism. A drive means comprising a drive roller 31 drives the carrier member 8 beneath the inked roller 30. The drive roller 31 which is driven by an electric motor 45 through a belt drive 46 comprises a shaft 32 rotatable in a bearing (not shown) in the metal support 26 and in a bearing 33 mounted in a support bracket 34 which is secured to the support 26 by screws 35. A pair of disc members 37 fast on the shaft 32 bear on the carrier member 8 to drive it beneath the inked roller 30.

Figure 1:
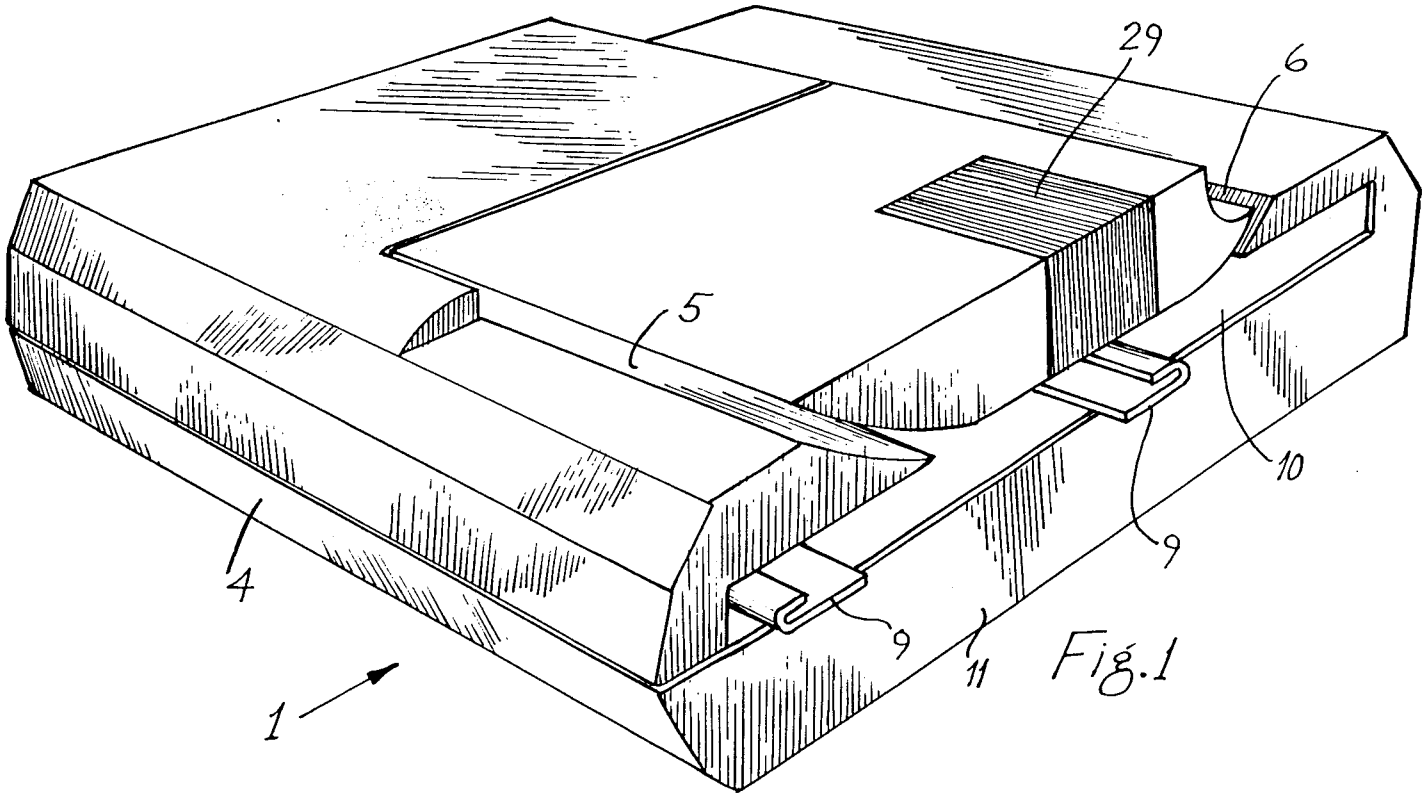
FIG. 1 is a perspective view of imprinter apparatus according to the invention.
Figure 2:
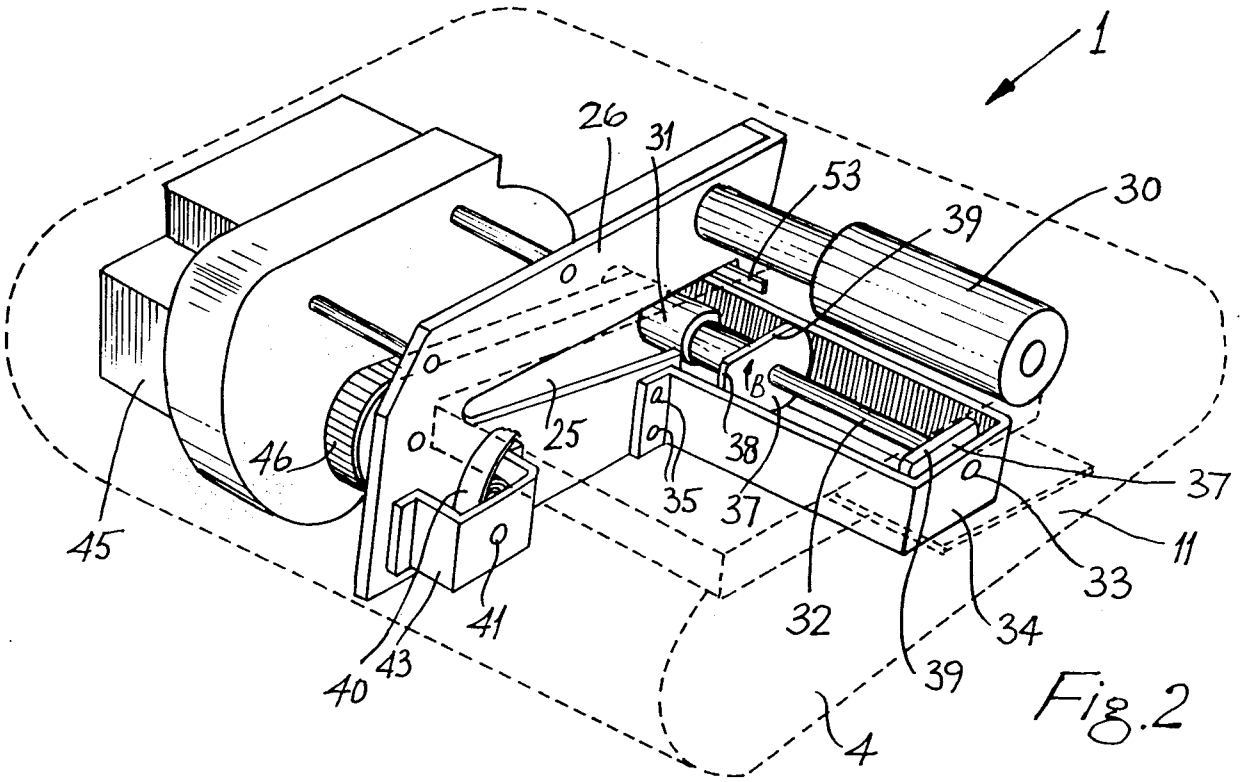
FIG. 2 is a perspective view of the imprinter apparatus with the housing and carrier member shown in broken lines.

As will be apparent particularly from FIGS. 3 and 4 each of the disc members 37 has a substantially cylindrical periphery 38 interrupted by a flattened portion 39, the cylindrical portion 38 engaging the carrier member 8 to advance the carrier member 8 between start and discharge positions and the flattened portion 39 allowing relative sliding movement of the carrier member 8 for return of the carrier member to the start position illustrated in FIG. 3. Return means for returning the carrier member 8 to the start position is in this case provided by a coiled tensator spring 40 mounted on a shaft 41 in a housing 43 and connected to the underside of the carrier member at 42. As the drive roller 31 rotates in the direction of the arrow B in FIG. 1 the cylindrical or rounded portion 38 of the periphery of the disc members 37 drives the carrier member beneath the inked roller 30 and the radius of the discs is such as to press the carrier member 8 against the inked roller 30 with sufficient force to cause imprinting of the characters from the credit card 2, merchants characters 18 and date roller characters 19 onto the document 3. Further, the circumference of the rounded portion 38 of the disc members 37 is such that one revolution of the drive roller 31 completes one pass of the carrier member beneath the ink roller, thus on completion of a pass imprinting is complete, the document 3 is discharged through the discharge opening 6 and the carrier member 8 is returned to the start position ready to receive another document.

Document sensor means to sense the presence of a document 3 on the carrier member 8 the drive roller 31 in this case comprises a microswitch 50 which is positioned to be activated by portion of the document 3 upon reaching the abutment 20 to energize the motor 45 for driving the carrier member 8 through an imprinting stroke.

Figure 5:
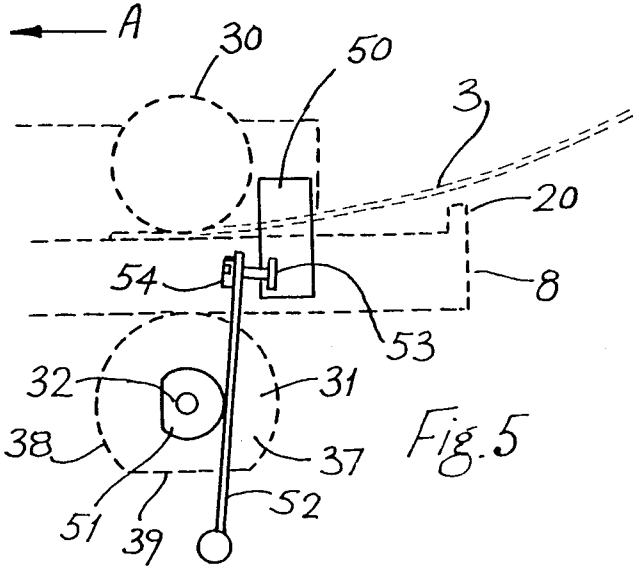
FIG. 5 is a side view of a detail of the apparatus of FIG. 1.
Figure 6:
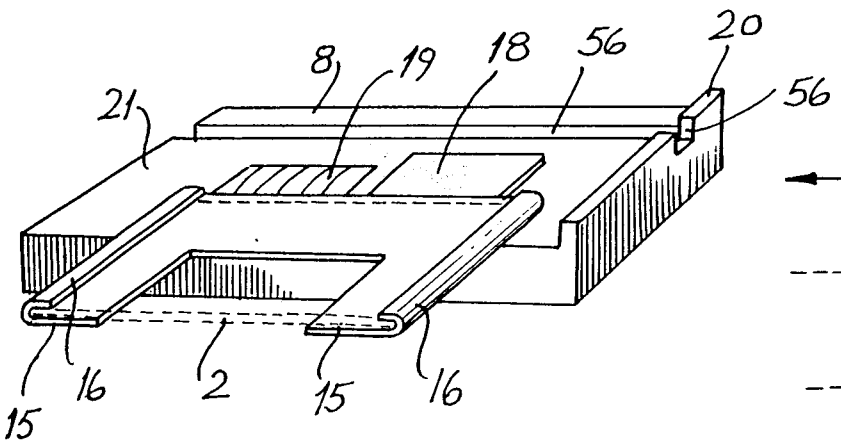
FIG. 6 is a perspective view of the carrier member of the apparatus of FIG. 1.

Referring to FIG. 5, means for retaining the microswitch 50 activated during an imprinting stroke thereby maintaining drive on the drive roller 31 is provided by a cam 51 on the shaft 32 of the drive roller which operates a pivotal member 52 which bears on an arm 53 of the microswitch to retain the microswitch 50 activated. An adjusting screw 54 is provided on the pivotal member 52 to bear on the arm 53. When the drive roller 31 has completed one revolution, the profile of the cam 51 is such that the pivotal member 52 is released from the microswitch arm 53, thus deactivating the microswitch 50 and turning off the motor 45.

Referring particularly to FIGS. 3 and 4 delivery means for delivering an imprinted document from the imprinter apparatus 1 through the exit opening 6 is in this case provided by a guide finger member 55 which extends into a groove 56 in the carrier member 8 when the carrier member approaches a discharge end position to move underneath the document 3 and direct it through the exit opening 6.

In use, the credit card 2 is entered into side members 16 of the carrier member 8 through the slot 10 in the side wall 11 of the housing 4. The carrier member 8 will be in the position illustrated in FIG. 3. The document 3 is then inserted through the entrance opening 5 in the housing 4 until it reaches the abutment 20 of the carrier member 8. Just as the document reaches the abutment 20 it triggers the microswitch arm 53, thereby activating the motor 45 and in turn the drive roller 31. As the drive roller 31 rotates, the rounded portion 38 of the circumference of the discs 37 drive the carrier member 8 between the drive roller 31 and the inked roller 30 in the direction of the arrow C of FIG. 4. The cam 51 and pivotal member 52 retains the microswitch 50 active, and in turn the motor 45. On completing a pass of the carrier member 8 between the inked roller 30 and the drive roller 31, the microswitch 50 is deactivated, and thus the motor 45. At this stage the flattened portion 38 of the discs 37 is adjacent the carrier member 8. The carrier member 8 is thus free to slide between the inked roller 30 and the driver roller 31, and the spring 40 thereby returns the carrier member 8 to its reset position illustrated in FIG. 3. While the carrier member 8 is being driven between the drive roller 31 and the inked roller 30, the characters on the credit card 2, the merchant's identification characters 18 and date roller characters 19 are imprinted onto the document 3. During this operation as the carrier member 8 moves in the direction of the arrow C of FIG. 4, the guide finger 55 directs the document 3 into the exit opening 6 and the document 3 is discharged through the opening 6. The credit card 2 is then removed, and the apparatus 1 is ready for the next operation.

It will be appreciated that while a particular drive means has been described for driving the carrier member between the print roller, any other suitable drive means could be used. For example, instead of having a pair of discs, an elongated roller could be used, and in this case it is envisaged that portion of the periphery of the roller would be flattened. Although needless to day, it will be appreciated that it is not necessary for the drive roller to be flattened. For example, in certain cases it is envisaged that a roller rotatable about an eccentric axis could be used. Also, it is envisaged that either a release means to release the pressure between the drive roller and the inked roller would be provided to allow for the return of the carrier member, or alternatively, the roller could be driven in reverse to return the carrier member.

It will also of course be appreciated that in certain cases the inked roller could be driven and it would drive the carrier member This, it will be appreciated, would eliminate the need for the drive roller. Further, it will be appreciated that any means other ther than an electric motor could be used to drive either the drive roller or the print roller. In certain cases, it is envisaged that a hand crank could be used.

Further, it will be appreciated that means other than a tensator spring could be used to return the carrier. It is envisaged that a coil spring may be used. It is envisaged that many other shapes and constructions of carrier member could be provided, as indeed could many other shapes and constructions of housing, as well as entrance and exit openings.

Furthermore, it will be appreciated that while the apparatus has been described for imprinting embossed information on a credit card onto a document, the apparatus could be used for imprinting information from any suitable imprint source member onto any type of document.

It will be appreciated that the drive roller means may be provided with a friction gripping means for movement of the carrier member. For example, in the case of the disc members 37 described above an O-ring or the like may be fitted over the outer periphery and may be located in a groove or recess in the disc member.

It will further be appreciated that means may be provided for adjusting the pressure applied by the imprint roller. For example, the imprint roller may be eccentrically mounted to allow pressure adjustment.

In addition, it will be appreciated that alignment means may be provided for alignment of the drive roller means with respect to the imprint roller. For example, the drive roller may be mounted in bearings, at least one of which is eccentric to allow adjustment of the drive roller.

Further, it will be appreciated that the imprinter apparatus according to the invention may be used in association with means for validating a credit card.

We claim:

1. Document actrvated imprinter apparatus for imprinting characters from a credit card or the like forming a thin character bearing imprint member onto a document, comprising a housing having entrance and exit openings for introduction and discharge of a document onto which characters are to be imprinted, imprint means in the housing including a printing station having an imprinter roller and a drive roller between which the document and imprint member are to be advanced, a carrier member movable within the housing along a feed path between a document receiving start position and a document discharge end position for advancing a document fed onto the carrier member through said entrance opening between said rollers, means on said carrier member for receiving and positioning the imprint member adjacent the document disposed on the carrier member to imprint characters on the document upon their passage between said rollers, means tor guiding and reciprocating said carrier member and the document and imprint member thereon along said feed path, powered drive means including a document sensor to sense the presence of a document at a support position on the carrier member to drive said drive roller through a carrier member imprint stroke along said feed path, means for guiding the document through said exit opening upon the carrier member reaching said end position, and means for returning the carrier member to said start position, said carrier member being a rigid platen having a flat upwardly facing surface with a recess in said surface for receiving said imprint member to be carried hereby at a position to form character imprints on the document, and said carrier member being shaped to admit said rollers into contact with the adjacent print member and document for imprinting characters on the document upon their passage between said rollers.

2. Document actrvated imprinter apparatus as defined in claim 1, wherein said housing includes guide means for guiding said platen along said feed path to pass the character source member and document between said rollers.

3. Document activated imprinter apparatus as defined in claim 1, wherein said platen includes an abutment surface extending upwardly form the substantially flat document supporting surface thereof to be abutted by a leading edge of the document upon insertion through said entrance opening to proper imprinting position on said platen, and sensor means positioned to be activated by a portion of the document upon reaching said abutment surface for activating said powered drive means to effect said imprinting stroke.

4. Document activated imprinter apparatus as defined in claim 2, wherein said platen includes an abutment surface extending upwardly form the substantially flat document supporting surface thereof to be abutted by a leading edge of the document upon insertion through said entrance opening to proper imprinting position on said platen, and sensor means positioned to be activated by a portion of the document upon reaching said abutment surface for activating said powered drive means to effect said imprinting stroke.

5. Document activated imprinter apparatus for imprinting characters from a credit card or the like forming a thin character bearing imprint member onto a document, comprising a housing having entrance and exit openings ior introduction and discharge of a document onto which characters are to be imprinted, imprinting means in the housing including a printing station having an imprint roller and a drive roller between which the document and imprint member are to be advanced, a carrier member movable within the housing along a feed path between a document receiving start position and a document discharge end positron for advancing a document fed onto the carrier member through said entrance opening between said rollers, means on said carrier member for receiving and positioning the imprint member adjacent the document disposed on the carrier member to imprint characters on the document upon their passage between said rollers, means for gurding and reciprocating said carrier member and the document and imprint member thereon along said feed path, powered drive means including a document sensor to sense the presence of a document at a support position on the carrier member to drive said drive roller through a carrier member imprint stroke along said feed path, means for guiding the document through said exit opening upon the carrier member reaching said end position, and means for returning the carrier member to said start position, said carrier member being a rigid platen, and said platen including an abutment surtace extending upwardly form the substantially flat document supporting surface thereof to be abutted by a leading edge of the document upon insertion through said entrance opening to proper imprinting position on said platen, and sensor means positioned to be activated by a portion of the document upon reaching said abutment surface for activating said powered drive means to effect said imprinting stroke.

6. Document activated imprinting apparatus as defined in claim 5, wherein said powered drive means is an electric motor coupled to said drive roller to drive the same to advance said carrier member through said imprint stroke.

7. Document activated imprinter apparatus as defined in claim 5, wherein said powered drive means is an electric motor coupled to said drive roller to drive the same to advance said carrier member through said imprint stroke, and said sensor means comprising a microswitch positioned to be activated by the document to energize said electric motor for driving said carrier member through its imprint stroke.

8. Document activated imprinter apparatus as defined in claim 3, wherein said powered drive means is an electric motor coupled to said drive roller to drive the same to advance said carrier member through saids imprint stroke, and said sensor means comprising a microswrtch positioned to be activated by the document to energize said electric motor for driving said carrier member through its imprint stroke.

9. Document activated imprinter apparatus as defined in claim 4, wherein said powered drive means is an electric motor coupled to said drive roller to drive the same to advance said carrier member through said imprint stroke, and said sensor means comprising a microswitch positioned to be activated by the document to energize said electric motor for driving said carrier member through its imprint stroke.

10. Document activated imprinter apparatus for imprinting characters from a credit card or the like forming a thin character bearing imprint member onto a document, comprising a housing having entrance and exit openings for introduction and discharge of a document onto which characters are to be imprinted, imprinting means in the housing including a printing station having an imprint roller and a drive roller between which the document and imprint member are to be advanced, a carrier member movable within the housing along a feed path between a document receiving start position and a document discharge end position for advancing a document fed onto the carrier member through said entrance opening between said rollers, means on said carrrer member for receiving and positioning the imprint member adjacent the document disposed on the carrier member to imprint characters on the document upon their passage between said rollers, means for guiding and reciprocating said carrier member and the document and imprint member thereon along said feed path, powered drive means including a document sensor to sense the presence of a document at a support position on the carrier member to drive said drive roller through a carrier member imprint stroke along said feed path, means tor guiding the document through said exit opening upon the carrier member reaching said end position, and means for returning the carrier member to said start position, said drive roller having a cylindrical periphery interrupted by a flat whereby cylindrical portions of the drive roller engage said carrier member to advance the same through said imprint stroke and said flat on the drive roller abutting the carrier member at the end of the imprint stroke for return of the carrier member to its start position, the apparatus including return means for returning the carrier member to said start position.

11. Document activated imprinter apparatus as defined in claim 1, wherein said housing includes guide means for guiding said platen along a feed path to pass the characters source member and document between said rollers.

12. Document activated imprinter apparatus as defined in claim 1, wherein said platen includes an abutment surface extending upwardly from the substantially flat document supporting surface thereof to be abutted by a leading edge of the document upon insertion through said entrance opening to proper imprinting position on said platen, and sensor means positioned to be activated by a portion of the document upon reaching said abutment surface for activating said powered drive means to effect said imprinting stroke.

13. Document activated imprinter apparatus as defined in claim 6, wherein said drive roller has a cylindrical periphery interrupted by a flat whereby cylindrical portions of the drive roller engage said platen to advance the same through said imprint stroke and said flat on the drive roller abuts the platen at the end of the imprint stroke for return of the carrier member to its start position, the apparatus including spring return means for returning the platen to said start position.

14. Document activated imprinter apparatus as defined in claim 1, including a guide finger member extending into a groove in the platen when the platen approaches said discharge end position to move underneath the document on the platen and direct the same through said exit opening of the housing for discharge from the apparatus.

15. Document activated imprinter apparatus as defined in claim 2, including a guide finger member extending into a groove in the platen when the platen approaches said discharge end position to move underneath the document on the platen and direct the same through said exit opening of the housing for discharge from the apparatus.

16. Document activated imprinter apparatus as defined in claim 3, including a guide finger member extending into a groove in the platen when the platen approaches said discharge end position to move underneath the document on the platen and direct the same through said exit opening of the housing for discharge from the apparatus.

17. Document activated imprinter apparatus as defined in claims 4, including a guide finger member extending into a groove in the platen when the platen approaches said discharge end position to move underneath the document on the platen and direct the same through said exit opening of the housing for discharge from the apparatus.

18. Document activated imprinter apparatus as defined in claim 5, including a guide finger member extending into a groove in the platen when the platen approaches said discharge end position to move underneath the document on the platen and direct the same through said exit opening of the housing for discharge from the apparatus.

* * * * *